US008256959B2

(12) United States Patent
Hui et al.

(10) Patent No.: US 8,256,959 B2
(45) Date of Patent: Sep. 4, 2012

(54) FASTENER STRIP, SLIDER AND RECLOSABLE CONTAINER COMPRISING SAME

(75) Inventors: Jonathan Hui, Hong Kong (CN); Mark Branson, Greenfield, IN (US)

(73) Assignee: Global Packaging Solutions Limited, Kowloon Bay (CN)

( * ) Notice: Subject to any disclaimer, the term of this patent is extended or adjusted under 35 U.S.C. 154(b) by 1228 days.

(21) Appl. No.: 11/424,016

(22) Filed: Jun. 14, 2006

(65) Prior Publication Data

US 2007/0292052 A1 Dec. 20, 2007

(51) Int. Cl.
*B65D 33/16* (2006.01)

(52) U.S. Cl. ..... 383/63; 383/59; 383/64

(58) Field of Classification Search ..... 383/61.1–61.3, 383/63, 64, 59

See application file for complete search history.

(56) References Cited

U.S. PATENT DOCUMENTS

| | | | | |
|---|---|---|---|---|
| 2,581,604 | A | 1/1952 | Roehrl | |
| 3,220,076 | A | 11/1965 | Ausnit | |
| 3,259,951 | A | 7/1966 | Zimmerman | |
| 4,819,309 | A * | 4/1989 | Behymer | 24/586.11 |
| 5,020,194 | A | 6/1991 | Herrington et al. | |
| 5,442,838 | A * | 8/1995 | Richardson et al. | 24/402 |
| 6,088,887 | A | 7/2000 | Bois | |
| 6,217,215 | B1 * | 4/2001 | Tomic | 383/63 |
| 6,287,001 | B1 | 9/2001 | Buchman | |
| 6,461,042 | B1 * | 10/2002 | Tomic et al. | 383/64 |
| 6,575,628 | B1 * | 6/2003 | Borchardt et al. | 383/64 |
| 6,581,253 | B2 * | 6/2003 | ErkenBrack | 24/428 |
| 6,582,122 | B2 * | 6/2003 | Shimizu | 383/63 |
| 6,595,689 | B1 | 7/2003 | Borchardt et al. | |
| 6,789,947 | B1 | 9/2004 | Kasai | |
| 6,817,763 | B2 | 11/2004 | Tomic | |
| 6,826,808 | B2 | 12/2004 | Kutschka | |
| 6,915,546 | B2 | 7/2005 | Kasai | |
| 6,964,519 | B2 * | 11/2005 | ErkenBrack | 383/64 |
| 7,017,240 | B2 | 3/2006 | Savicki | |
| 7,189,001 | B2 * | 3/2007 | Gerrits | 383/63 |
| 2002/0114540 | A1 * | 8/2002 | Shimizu | 383/63 |
| 2003/0077009 | A1 * | 4/2003 | Schreiter | 383/64 |
| 2003/0223654 | A1 * | 12/2003 | Gerrits | 383/63 |
| 2004/0010893 | A1 * | 1/2004 | Kasai | 24/438 |
| 2004/0045134 | A1 * | 3/2004 | Savicki | 24/30.5 R |
| 2004/0045138 | A1 | 3/2004 | Kasai | |

(Continued)

FOREIGN PATENT DOCUMENTS

| | | |
|---|---|---|
| JP | 2004083068 | 3/2004 |
| JP | 2004196321 | 7/2004 |

*Primary Examiner* — Jes F Pascua
(74) *Attorney, Agent, or Firm* — Vedder Price P.C.

(57) ABSTRACT

A fastener strip, such as would be used in a reclosable container, comprises a sealing member having a plurality of sealing portions configured to engage complementary sealing portions of a complementary fastener strip. At least one sealing portion comprises one or more finger members extending therefrom. The at least one finger member, by engaging a complementary sealing portion of a complementary fastener strip, provides an additional degree of sealing, particularly when the fastener strips are in a partially engaged condition. A slider comprises top and side walls and inwardly facing flanges, preferably at lower ends of the side walls. The inwardly facing flanges define a gap having dimensions such that the sealing members of the opposing fastener strips, and particularly the sealing portion having the at least one finger member and its complementary sealing portion, are urged together to provide an additional degree of sealing, yet not completely interlocking, engagement.

14 Claims, 3 Drawing Sheets

U.S. PATENT DOCUMENTS

2004/0066984 A1 4/2004 Yi Li
2004/0136617 A1* 7/2004 Gerrits ..... 383/63
2004/0165794 A1 8/2004 Plourde
2004/0252916 A1* 12/2004 Smith et al. ..... 383/64
2006/0171610 A1 8/2006 Buchman et al.
2006/0269170 A1* 11/2006 Chaturvedi ..... 383/64

* cited by examiner

FASTENER STRIP, SLIDER AND RECLOSABLE CONTAINER COMPRISING SAME

FIELD OF THE INVENTION

The present invention generally relates to reclosable containers and, in particular, to fastener strips and sliders that may be incorporated into such reclosable containers.

BACKGROUND OF THE INVENTION

Reclosable containers, particularly reclosable bags, are well known in the art. One type of reclosable bag comprises flexible side walls having complementary fastener strips mounted along an upper edge of the side walls, and a slider mounted upon, and capable of traversing along a longitudinal length of, the fastener strips. Each fastener strip has a sealing member that, in turn, has a profile that is complementary to the sealing member of the opposing fastener strip. As the slider traverses the fastener strips in one direction, the sealing members of the opposing fastener strips are urged into an engaged, interlocking condition by closing gates disposed at one end of the slider, thereby providing a substantially leak-proof seal. Conversely, as the slider traverses the fastener strips in the opposite direction, the fastener strips are disengaged by a separating mechanism also forming a part of the slider at an opposite end thereof, thereby breaking the seal and allowing access to the interior of the reclosable container.

While such reclosable containers generally work well and have been widely marketed and consumed, certain shortcomings still persist. For example, at a point along the length of the fastener strips where the slider resides, particularly at the location of the separating mechanism along the fastener strips, the sealing members are either completely disengaged or maintained in a partially engaged state such that leakage of the contents of the reclosable container is still possible. This is particularly troublesome where, for example, a user of the reclosable container has positioned the slider at an end of the fastener strips corresponding to a "completely" closed or sealed condition for the container, i.e., the user assumed that the container has been fully sealed. In this case, the expectations of the user may not be fully met to the extent that the partial engagement or complete disengagement of the fastener strips may result in leaks, thereby leading to a negative user experience. Thus, it would be advantageous to provide reclosable containers that overcome this limitation of the prior art.

SUMMARY OF THE INVENTION

In light of the above, the present invention provides fastener strips and sliders for use in reclosable containers that substantially overcome the limitation of prior art devices. In one aspect of the present invention, a fastener strips comprises a sealing member having a plurality of sealing portions configured to engage complementary sealing portions of a complementary fastener strip. At least one sealing portion, preferably a lowermost sealing portion, of the fastener strip's sealing member comprises at least one finger member extending therefrom substantially along the entire length of the fastener strip. The at least one finger member, by engaging a complementary sealing portion of the complementary fastener strip, provides an additional degree of sealing, particularly when the fastener strips are in a partially engaged condition. In another aspect of the present invention, a slider comprises an elongate body having top and side walls.

Inwardly facing flanges or rails are disposed on, preferably at lower ends of, the side walls. The inwardly facing flanges are configured substantially directly opposite each other and possess dimensions such that they define a gap between outermost surfaces of the inwardly facing flanges. The gap defined by the inwardly facing flanges has dimensions such that the sealing members of the opposing fastener strips, and particularly the sealing portion having the at least one finger member and its complementary sealing portion, are urged together to provide an additional degree of sealing, yet not completely interlocking, engagement. Preferably, the gap has dimensions that are at least less then a combined width of the fastener strips when they are in a partially engaged condition. Fastener strips and/or sliders in accordance with the present invention may be beneficially incorporated into reclosable containers, particularly reclosable bags.

BRIEF DESCRIPTION OF THE DRAWINGS

The features of the present invention are set forth with particularity in the appended claims. The invention itself, together with further features and attendant advantages, will become apparent from consideration of the following detailed description, taken in conjunction with the accompanying drawings. An embodiment of the invention is now described, by way of example only, with reference to the accompanying drawings wherein like reference numerals represent like elements and in which:

DETAILED DESCRIPTION OF THE PRESENT EMBODIMENTS

Figure 1:
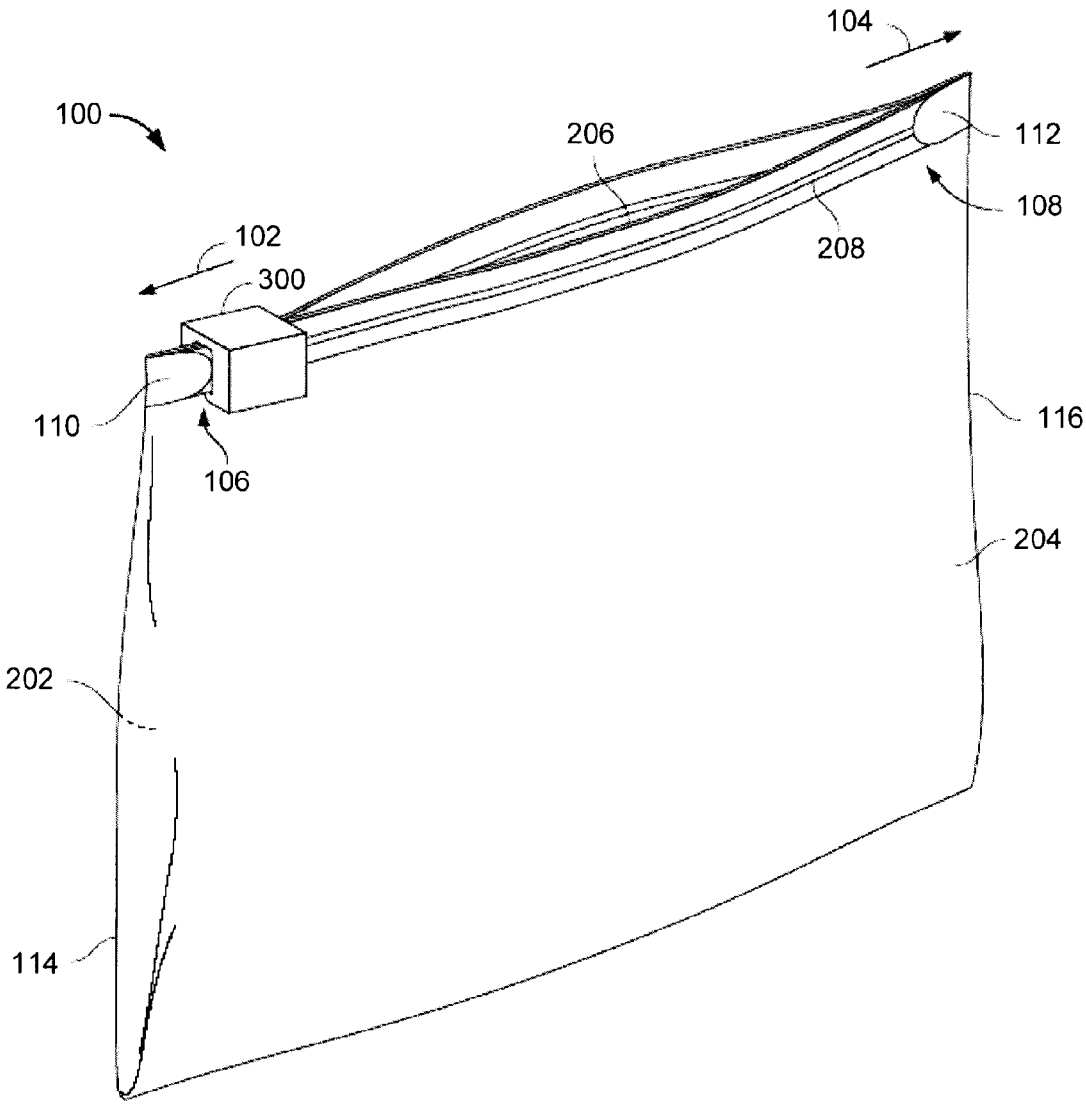
FIG. 1 is a perspective view of a reclosable container in accordance with the present invention.

Referring now to said FIG. 1, a bag or, more generally, reclosable container 100 is illustrated. As shown, the bag 100 comprises walls 202, 204 sealed along the lateral edges 114, 116 of the walls 202, 204 to form an open-ended container. Materials commonly used in the art, such as LLDPE, LDPE, Nylon PP, or PET, may be used to form the walls 202, 204. Complementary fasteners strips 206, 208 in accordance with the present invention are mounted along upper edges of the walls 202, 204. In a presently preferred embodiment, the fastener strips 206, 208 are formed integrally with, and from the same material as, the walls 202, 204 through an extrusion process. However, the present invention is not limited in this regard and other techniques known to those having skill in the art may be employed to attach the fastener strips 206, 208 to their corresponding walls 202, 204. A slider 300 in accordance with the present invention (preferably constructed of polyethylene, polycarbonate, polystyrene, acryl nitryl butyldirene styrene or other materials commonly used in the fabrication of formed injection molded plastic pieces) is disposed on the fastener strips 206, 208. As known in the art, the slider 300 may slide in a first or opening direction 102 or, oppositely, in a second or closing direction 104 along a longitudinal length of the fastener strips 206, 208 as shown. Travel of the slider 300 along the fastener strips 208, 208 is limited at a proximal end 110 by a first stop position 106 and, at a distal end 112, by a second stop position 108. In practice, the stop positions 106, 108 are formed by fusing the fastener strips 206, 208 together using known techniques, such as ultrasonic sealing.

Figure 2:
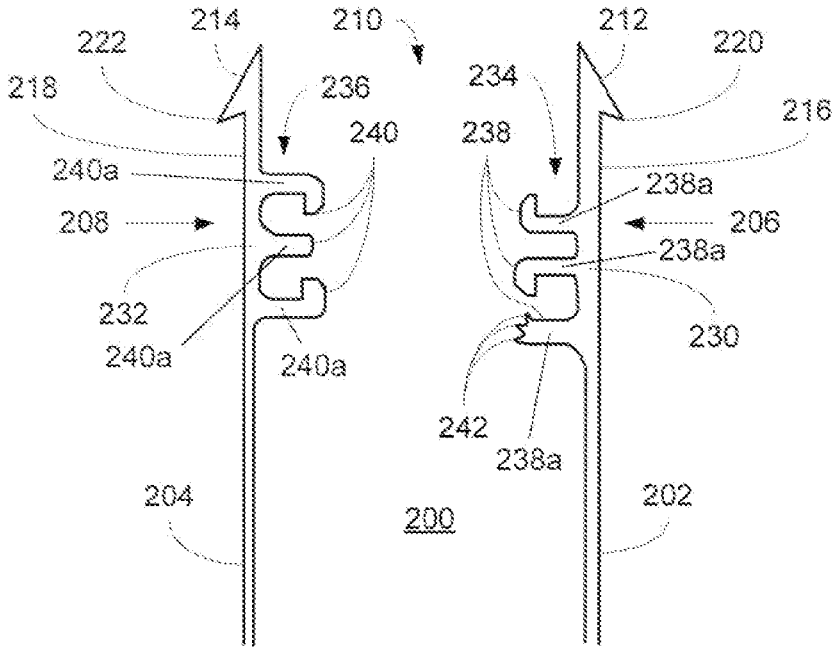
FIG. 2 is a partial, cross-sectional view of exemplary fastener strips in accordance with an embodiment of the present invention.

Referring now to FIG. 2, a partial, cross-sectional view of exemplary fastener strips 206, 208 of fastener apparatus 200 is illustrated. Generally, the cross-sectional profiles of the various components illustrated in FIG. 2 run the entire longitudinal length of the fastener strips 206, 208. As shown, each fastener strip 206, 208 comprises a base 230, 232 and a sealing member 234, 236 formed thereon, preferably in a continuous, integral fashion. In a presently preferred embodiment, each fastener strip 206, 208 is mounted on a upper edge 216, 218 of a corresponding wall 202, 204 of the bag 100. The sealing members 234, 236 each comprise a plurality of complementary sealing portions 238, 240 that, when coupled together in an engaged condition (see FIG. 7), provide a substantially leak-proof seal for the bag 100. Each sealing portion 238, 240 may include a post 238*a*, 240*a*. The post is a component of sealing portion 238, 240 that laterally extends the end of sealing portion 238, 240 away from bases 232, 230. The sealing portions 238, 240 preferably have profiles that cause the sealing members 234, 236 to interlock when fully engaged with each other. As known in the art, the interdigitation of the complementary sealing portions 238, 240 when the sealing members 206, 208 are fully engaged provides multiple sealing points that substantially run along the entire longitudinal length of the fastener strips. Although particular profiles are shown for the complementary sealing portions 238, 240 for the purposes of illustration, the present invention is not limited to the profiles shown.

As further shown in FIG. 2, each fastener strip 206, 208 preferably comprises an upward extending guide rail 212, 214. In a presently preferred embodiment, the guide rails 212, 214 serve to retain a slider on the fastener strips 206, 208. To this end, each guide rail 212, 214 preferably comprises a protrusion 220, 222. In the example illustrated in FIG. 2, each protrusion 220, 222 comprises an outward facing flange, although other configurations, such as an inward facing flange, a combination of inward and outward facing flanges or a substantially circular profile could be equally employed. Furthermore, the present invention is not limited to a particular implementation of the guide rails 212, 214, and more conventional guide rail configurations (for example, along the opposite, outward-facing sides of the bases 230, 232) may be equally employed.

In a further aspect of the present invention, one of the plurality of sealing portions 238 of a first sealing member 234 additionally comprises one or more finger members 242. Although the finger members 242 are illustrated as forming part of only one of the sealing portions 238 and of only the first sealing member 234, it is understood that additional finger members may be equally incorporated into other ones of the sealing portions 238 of the first sealing member 234, or additionally into one or more of the sealing portions 240 of the second sealing member 236. In a presently preferred embodiment, the one or more finger members 242 are incorporated into a lowermost sealing portion of the plurality or sealing portions 238. As discussed above, sealing portion 238 may include a post 238*a* that laterally extends the end of a sealing portion 238 away from base 230. As such a post 238*a* may extend the finger members 242 of a sealing portion 238 away from base 230 in one embodiment. Furthermore, each finger member 242 preferably extends laterally and/or partially upwardly relative to the sealing portion in which it is formed. Further still, where more than one finger member 242 is employed, each finger member 242 preferably extends at a different angle relative to the others. As described in greater detail below, particularly with reference to FIG. 8, the finger members 242 provide a sealing engagement with a complementary portion of the sealing member 236 of the second fastener strip 208 when the fastener strips 206, 208 are maintained in a partially engaged condition, i.e., at the point along, the longitudinal length of the fastener strips 206, 208 where a separator 312 of the slider 300 causes the disengagement of the fastener strips 206, 208.

Referring now to FIGS. 3-6 an exemplary slider 300 in accordance with the present invention is further illustrated. Generally, the slider 300 comprises an elongate body 302 having a top wall 304 and sidewalls 306, 308 extending downwardly from the top wall 304. Although the side walls 306 and 308 may extend substantially perpendicular to the top wall 304, they may also be angled relative to the top wall 304 and, in one embodiment of the present invention (as best illustrated in FIGS. 4, 5, 7 and 8), they are preferably tilted inward approximately 2 degrees from perpendicular relative to the top wall 304. At a proximal end 301 of the slider 300, a front wall 310 is provided and, likewise, a back wall 501 is provided at a distal end 303. The front and back walls 310, 501 are preferably (but not necessarily) substantially perpendicular to the top and side walls 304-308. Collectively, the top wall 304 and sidewalls 306 and 308 form an opening 314 (FIGS. 3 and 6) running along the entire length of the elongate body 302, thereby allowing passage of the fastener strips 206, 208 through the slider 300 as the slider traverses along the longitudinal length of the fastener strips 206, 208.

Figure 8:
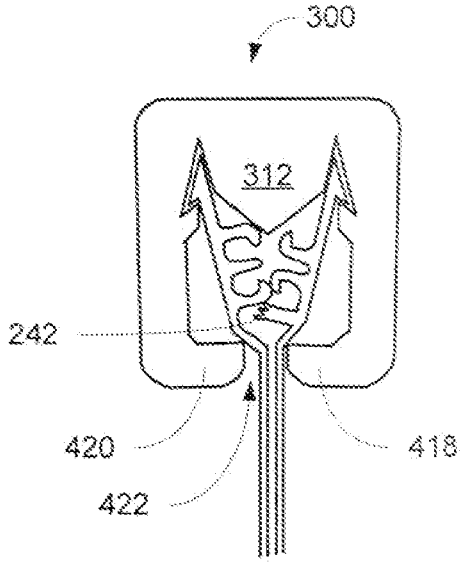
FIG. 8 is a partial, cross-section view of exemplary fastener strips in a partially opened position and exemplary slider illustrating operation thereof in accordance with the present invention.
Figure 3:
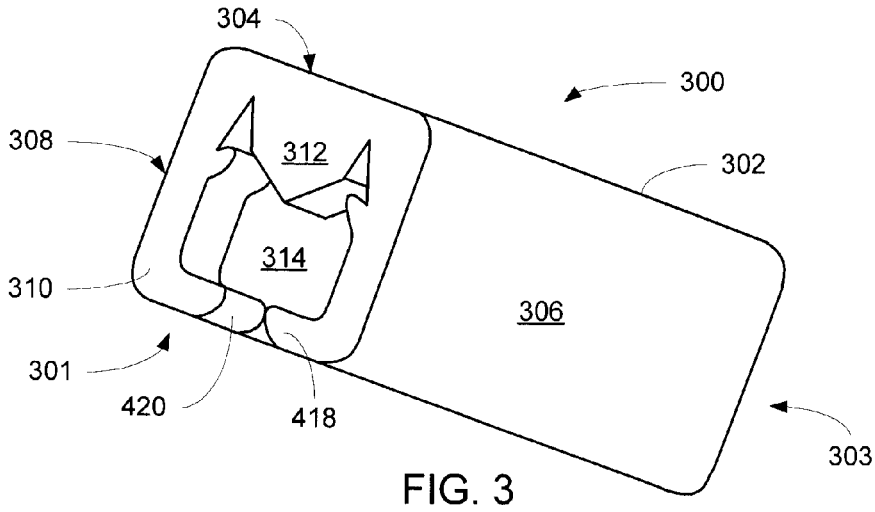
FIG. 3 is a perspective view of an exemplary slider in accordance with another embodiment of the present invention.
Figure 4:
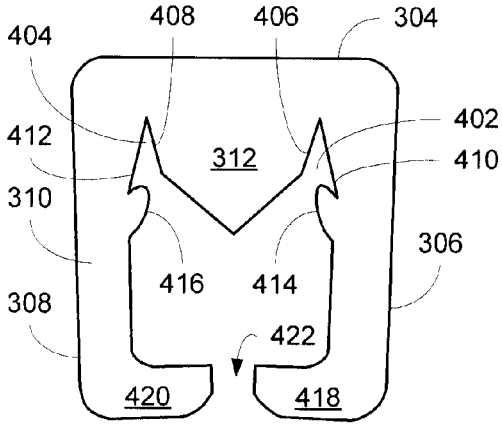
FIG. 4 is a front elevation view of the exemplary slider of FIG. 3.
Figure 6:
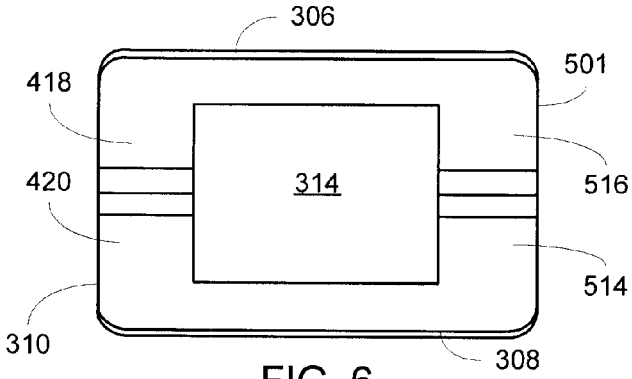
FIG. 6 is a bottom plan view of the exemplary slider of FIG. 3.

As further illustrated in FIGS. 3, 4 and 6, the slider 300 further comprises substantially opposing, inward facing flanges or rails 418, 420. The inward facing flanges 418, 420 extend substantially perpendicularly relative to the sidewalls 306, 308, although this is not a requirement and other angles may be equally employed. Furthermore, the distal ends of the flanges 418, 420 define a gap 422 having dimensions such that the sealing members of the opposing fastener strips 206, 208, and particularly the sealing portion 238 having the at least one finger member 242 and its complementary sealing portion 240, are urged together to provide an additional degree of sealing, yet not completely interlocking, engagement, as best illustrated in FIG. 8. Note that where, as in the above-described preferred embodiment, the side walls 306, 308 are angled inwardly, the flanges 418, 420 may likewise be angled upwardly (relative to parallel with the top wall 304). In a presently preferred embodiment, the gap 422 is configured to be smaller than a combined width of the fastener strips 206, 208 when they are in a partially engaged condition. In another aspect of a presently preferred embodiment, the inward facing flanges 418, 420 are preferably formed within the front wall 310. In a similar vein, an additional pair of inward facing flanges 514, 516, defining therebetween another gap 512, are likewise disposed within the back wall 501. The additional inward facing flanges 514, 516 are preferably affected by any angle of the side walls 306, 308 in a substantially identical manner as the first-mentioned inward facing 418, 420. Those having ordinary skill in the art will appreciate that the inward facing flanges could run along the entire length of the elongate body 302 rather than being disposed solely within the end walls 310, 501 of the slider 300, although this is not presently preferred.

In order to retain the slider 300 on the fastener strips 206, 208, downward facing channels 402, 404 are formed in the front wall 310. In a presently preferred embodiment, each downward facing channel 402, 404 is defined by side portions 406, 408 of a separator 312 and by upper surfaces of grip rails 414, 416. In the manner, the resulting profiles 410, 412 of the downward facing channels 402, 404 substantially match the profiles of the corresponding guide rails 212, 214. The separator 312 comprises dimensions and is configured to induce separation of the sealing members 234, 236 of the corresponding fasteners strips 206, 208 without actually extending between sealing members 234, 236. As the slider 300 traverses the engaged fasteners strips 206, 208, the separator block 312 causes the fasteners strips 206, 208 to disengage thereby opening the bag 100.

Figure 5:
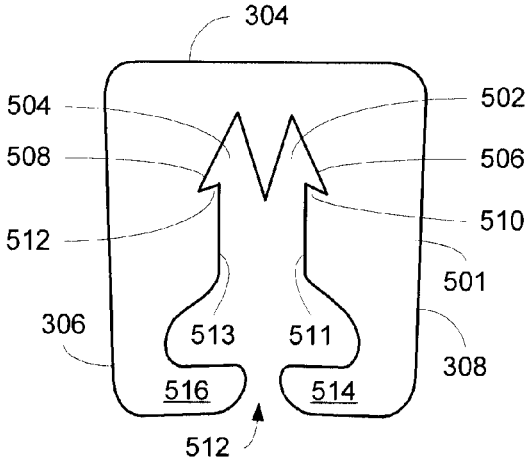
FIG. 5 is a rear elevation view of the exemplary slider of FIG. 3.

Referring to FIG. 5, the back wall 501 has formed therein additional downward facing channels 502, 504 having profiles 506, 508 that substantially match the profiles of the guide rails 212, 214, Once again, additional grip rails 510, 512 are provided to engage the protrusions 220, 222 of the guide rails 212, 214 thereby retaining the slider 300 on the fastener strips 206, 208. In contrast to the front wall 310, the back wall 501 comprises closing gates 511, 513 configured such that the space provided between the closing gates 511, 513 forces together the sealing portions 234 of the first fastener strip 206 and the complementary sealing portions 236 of the second fastener strip 208 (see FIG. 7), thereby establishing an interlocking, engaged condition between the fastener strips 206, 208 and providing a substantially leak-proof seal.

Figure 7:
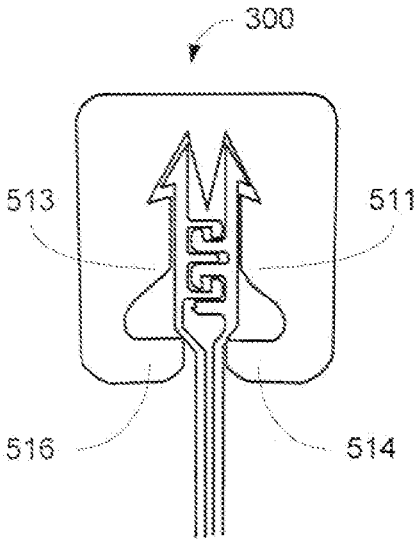
FIG. 7 is a partial, cross-section view of the exemplary fastener strips and the exemplary slider illustrating operation thereof in accordance with the present invention.

Referring now to FIG. 7, operation of the slider 300 in conjunction with the fastener strips 206, 208 is further illustrated. In particular, as the slider 300 is moved in the closing direction 104, the closing gates 511, 513 cause the complimentary sealing portions of the sealing members 234, 236 to engage in a interlocking fashion as shown. Once again, note that the inward facing flanges 514, 516 provide substantially no aid in retaining the slider 300 on the fastener strips 206, 208 in this and other embodiments. Illustrated in FIG. 8, the slider 300 travels along the fastener strips 206, 208 in the opening direction 102, the separator 312 causes the plurality of complimentary sealing portions 238, 240 of the sealing members 234, 236 to disengage thereby opening the bag. Note that, at the position of the slider 300 along the fastener strips 206, 208, particularly the position of the separator 312, the sealing members 234, 236 are maintained in a partially engaged condition that, in prior art devices, would cause leaks at that location. In accordance with the present invention, however, the configuration of the inward facing flanges 418, 420 and the resulting gap 422 defined therebetween, causes the one or more finger members 242 to engage a corresponding portion of the opposing sealing member thereby providing additional leak resistance at the point of the slider 300 along the fastener strips 206, 208.

While the invention has been described with respect to certain preferred embodiments, it will be understood by those of skill in the art that there are modifications, substitutions and other changes that can be made, yet will still fall within the intended scope of the invention.

The invention claimed is:

1. An elongate flexible fastener apparatus for use with a reclosable bag, the fastener apparatus comprising:

a first flexible fastener strip comprising:

a first base; and a first sealing member, attached to the first base, including a plurality of first sealing portions each having a post extending from the first base; and a complementary fastener strip comprising:

a second base; and a complementary sealing member, attached to the second base, including a plurality of complementary sealing portions each having a post extending from the second base, each of the plurality of first sealing portions being configured to engage the complementary sealing portion when the fastener is maintained in a fully engaged condition; and wherein one of the complementary sealing portions of the plurality of complementary sealing portions additionally engages an additional sealing portion disposed in a lowermost portion of the first sealing member, the additional sealing portion including a post having at least one finger member extending from the post laterally and upwardly such that the at least one finger member is configured to sealingly engage the post of one of the complementary sealing portions, that is not complementary to the additional sealing portion, when the fastener is maintained in a partially engaged condition.

2. The fastener apparatus of claim 1, wherein each finger member of a plurality of finger members extends from the post of the additional sealing member at a different angle relative to other finger members of the plurality of finger members.

3. The fastener apparatus of claim 1, wherein the at least one finger member sealingly engages the post of one of the complementary sealing portions in a region of the fastener strip where a slider, when retained on the fastener strip, resides.

4. The fastener apparatus of claim 1, further comprising:

an elongate guide rail disposed on an upper edge of the first fastener strip, the guide rail including at least one protrusion configured to retain a slider on the first fastener strip.

5. A reclosable bag comprising:

first and second flexible walls;

a first flexible fastener strip attached to the first flexible wall and adjacent an opening formed by the first and second walls, the first flexible fastener strip comprising:

a first base; and a first sealing member, attached to the first base, including a plurality of first sealing portions each having a post extending from the first base; and a complementary fastener strip attached to the second flexible wall and adjacent the opening, the complementary fastener strip comprising:

a second base; and a complementary sealing member, attached to the second base, including a plurality of complementary sealing portions each having a post extending from the second base, each of the plurality of first sealing portions being configured to engage the complementary sealing portion when the fastener is maintained in a fully engaged condition; and wherein one of the complementary sealing portions of the plurality of complementary sealing portions additionally engages an additional sealing portion disposed in a lowermost portion of the first sealing member, the additional sealing portion and including a post having at least one finger member extending from the post laterally and upwardly such that the at least one finger member is configured to sealingly engage the post of one of the complementary sealing portions, that is not complementary to the additional sealing portion, when the fastener is maintained in a partially engaged condition.

6. The reclosable bag of claim 5, wherein each finger member of a plurality of finger members extends from the post at a different angle relative to other finger members of the plurality of finger members.

7. The reclosable bag of claim 5, wherein the at least one finger member sealingly engages the post of one of the complementary sealing portions in a region of the complementary fastener strip where a slider, when retained on the fastener strip, resides.

8. The reclosable bag of claim 5, further comprising a slider having:

an elongate body having a top wall and side walls extending downward from, and substantially perpendicular to, the top wall; and inwardly facing flanges at lower ends of the side walls, the inwardly facing flanges defining a gap therebetween configured to urge the first portion of the first sealing member and the first complementary portion of the complementary sealing member of the complementary fastener strip together such that the at least one finger sealingly engages the first complementary portion.

9. The reclosable bag of claim 5, wherein the inwardly facing flanges are substantially perpendicular to the side walls.

10. The reclosable bag of claim 5, wherein the side walls are configured to extend downwardly past the first and the complementary fastener strips.

11. The reclosable bag of claim 5, wherein the gap defined by the inwardly facing flanges is smaller than a combined width of the first and the complementary fastener strips when they are in a partially engaged condition, thereby urging the at least one finger member to sealingly engage the first complementary portion.

12. A reclosable bag comprising:

first and second flexible walls;

a first flexible fastener strip attached to the first flexible wall and adjacent an opening formed by the first and second walls, the first flexible fastener strip comprising:

a first base; and a first sealing member, attached to the first base, including a plurality of first sealing portions each having a post extending from the first base; and a complementary fastener strip attached to the second flexible wall and adjacent the opening, the complementary fastener strip comprising:

a second base;

a complementary sealing member, attached to the second base, including a plurality of complementary sealing portions each having a post extending from the second base, each of the plurality of first sealing portions being configured to engage the complementary sealing portion when the fastener is maintained in a fully engaged condition; and wherein one of the complementary sealing portions of the plurality of complementary sealing portions additionally engages an additional sealing portion disposed in a lowermost portion of the first sealing member, the additional sealing portion and including a post having at least one finger member extending from the post laterally and upwardly such that the at least one finger member is configured to sealingly engage the post of one of the complementary sealing portions, that is not complementary to the additional sealing portion, when the fastener is maintained in a partially engaged condition;

a slider; and an elongate guide rail disposed on an upper edge of at least one of the first fastener strip and the complementary fastener strip including at least one protrusion configured to retain the slider on the fastener strip.

13. The reclosable bag of claim 12, wherein the post for each of the plurality of sealing portions is integrally formed to define one post.

14. The reclosable bag of claim 12, further comprising a slider having:

an elongate body having a top wall and side walls extending downward from, and substantially perpendicular to, the top wall; and inwardly facing flanges at lower ends of the side walls, the inwardly facing flanges defining a gap therebetween configured to urge the first portion of the first sealing member and the first complementary portion of the sealing member of the complementary fastener strip together such that the means for sealingly engaging the first complementary portion are effective to seal said reclosable bag when the first portion of the first sealing member and the first complementary portion of the sealing member are brought together, the slider having profiles that substantially match the profiles of the corresponding guide rails on the upper edges of the fastener strip.

* * * * *